US009052065B2

(12) United States Patent
Mackey

(10) Patent No.: US 9,052,065 B2
(45) Date of Patent: Jun. 9, 2015

(54) LIQUID DISPENSER

(75) Inventor: Michael Mackey, San Diego, CA (US)

(73) Assignee: GP STRATEGIES CORPORATION, Columbia, MD (US)

( * ) Notice: Subject to any disclaimer, the term of this patent is extended or adjusted under 35 U.S.C. 154(b) by 551 days.

(21) Appl. No.: 13/305,102

(22) Filed: Nov. 28, 2011

(65) Prior Publication Data

US 2012/0137708 A1 Jun. 7, 2012

Related U.S. Application Data

(60) Provisional application No. 61/418,679, filed on Dec. 1, 2010.

(51) Int. Cl.
*F17C 13/02* (2006.01)
*F17C 7/02* (2006.01)

(52) U.S. Cl.
CPC ..... *F17C 13/026* (2013.01); *F17C 7/02* (2013.01); *F17C 13/023* (2013.01)

(58) Field of Classification Search
USPC ..... 73/718, 724, 708, 32 R, 195, 304 C; 62/50.1, 50.7, 49.1; 324/690; 374/148; 222/70
See application file for complete search history.

(56) References Cited

U.S. PATENT DOCUMENTS 3,933,030 A 1/1976 Forster et al.
4,011,746 A 3/1977 Weitz, Jr. et al.
4,835,456 A * 5/1989 Liu et al. ..... 324/674
4,854,128 A * 8/1989 Zeamer ..... 62/50.1
5,121,609 A 6/1992 Cieslukowski
5,228,295 A 7/1993 Gustafson
5,231,838 A 8/1993 Cieslukowski
5,353,849 A * 10/1994 Sutton et al. ..... 141/44
5,411,374 A 5/1995 Gram
5,477,690 A 12/1995 Gram
5,551,488 A 9/1996 Gram
5,616,838 A * 4/1997 Preston et al. ..... 73/195
5,680,964 A * 10/1997 Wardle ..... 222/146.6
5,682,750 A 11/1997 Preston et al.

(Continued)

FOREIGN PATENT DOCUMENTS

EP 0 723 144 A2 7/1996
EP 1 184 616 A2 3/2002

(Continued)

OTHER PUBLICATIONS

Stängl et al., "Void Fraction Measurement in Subcooled Forced Convective Boiling with Refrigerant 12," *Experimental Heat Transfer*, 1990, pp. 323-340, vol. 3, No. 3, England.

(Continued)

*Primary Examiner* — Marc Norman
*Assistant Examiner* — Max Snow
(74) *Attorney, Agent, or Firm* — Finnegan, Henderson, Farabow, Garrett & Dunner, LLP

(57) ABSTRACT

Embodiments of the disclosure may include a dispenser for dispensing a liquid. The dispenser may include a measurement chamber configured to receive the liquid, a temperature probe positioned within the measurement chamber, and a capacitance probe positioned within the measurement chamber. The capacitance probe may house the temperature probe. The dispenser may also include a first conduit fluidly coupled to the measurement chamber and configured to deliver the liquid out of the dispenser.

20 Claims, 5 Drawing Sheets

(56) References Cited

U.S. PATENT DOCUMENTS

| | | | | |
|---|---|---|---|---|
| 5,701,932 | A | 12/1997 | Bourscheid et al. | |
| 5,787,940 | A | 8/1998 | Bonn et al. | |
| 5,861,755 | A * | 1/1999 | Moerk et al. | 324/663 |
| 5,954,101 | A * | 9/1999 | Drube et al. | 141/82 |
| 6,044,647 | A * | 4/2000 | Drube et al. | 62/50.1 |
| 6,142,191 | A * | 11/2000 | Sutton et al. | 141/59 |
| 6,148,666 | A * | 11/2000 | Roesicke | 73/290 R |
| 6,354,088 | B1 * | 3/2002 | Emmer et al. | 62/50.1 |
| 6,380,750 | B1 * | 4/2002 | Schenck et al. | 324/690 |
| 6,382,235 | B1 | 5/2002 | Drube et al. | |
| 6,505,470 | B1 | 1/2003 | Drube et al. | |
| 6,595,048 | B1 * | 7/2003 | Drube et al. | 73/195 |
| 6,622,758 | B2 | 9/2003 | Drube et al. | |
| 6,631,615 | B2 | 10/2003 | Drube et al. | |
| 6,640,554 | B2 | 11/2003 | Emmer et al. | |
| 6,692,034 | B2 | 2/2004 | Drube et al. | |
| 6,732,594 | B2 | 5/2004 | Drube et al. | |
| 6,955,095 | B2 | 10/2005 | Drube et al. | |
| 7,069,730 | B2 | 7/2006 | Emmer et al. | |
| 7,490,605 | B2 * | 2/2009 | Frye et al. | 128/201.21 |
| 8,255,175 | B2 * | 8/2012 | Boulanger et al. | 702/47 |
| 8,353,209 | B1 * | 1/2013 | Zimmerli | 73/290 B |
| 2002/0032014 | A1 * | 3/2002 | Gogolla et al. | 455/196.1 |
| 2003/0117153 | A1 * | 6/2003 | McKenzie et al. | 324/663 |
| 2004/0231411 | A1 * | 11/2004 | Drube et al. | 73/195 |
| 2005/0274127 | A1 * | 12/2005 | Drube et al. | 62/50.2 |
| 2006/0218941 | A1 * | 10/2006 | Drube | 62/50.2 |
| 2008/0307800 | A1 * | 12/2008 | Levin et al. | 62/50.7 |
| 2009/0061646 | A1 * | 3/2009 | Chiang et al. | 438/763 |
| 2009/0157345 | A1 * | 6/2009 | Yoshioka et al. | 702/136 |
| 2011/0083448 | A1 * | 4/2011 | Thompson et al. | 62/49.1 |
| 2011/0270542 | A1 * | 11/2011 | Chappell et al. | 702/55 |

FOREIGN PATENT DOCUMENTS

| | | | |
|---|---|---|---|
| GB | 1 429 678 | A | 3/1976 |
| WO | WO 92/02788 | A1 | 2/1992 |
| WO | WO 94/03755 | A1 | 2/1994 |

OTHER PUBLICATIONS

Search Report issued on May 8, 2012 in corresponding PCT application No. PCT/US2011/062564, 5 pages.

"Metrology for Liquefied Natural Gas (LNG)," EURAMET, European Metrology Research Programme, Energy 2009—Topic 10, pp. 1-4.

Benito, Angel, "Accurate Determination of LNG Quality Unloaded in Receiving Terminals: An Innovative Approach," pp. 1-23, Oct. 2009.

Butcher et al., National Institutes of Standards and Technology, Handbook 44, Section 3.37 Mass Flow Meters, 2010 Edition, pp. 3.99-3.112.

* cited by examiner

LIQUID DISPENSER

CROSS REFERENCE TO RELATED APPLICATION

This patent application claims the benefit of priority under 35 U.S.C. §§119 and 120 to U.S. Provisional Patent Application No. 61/418,679, filed Dec. 1, 2010, which is incorporated herein by reference in its entirety.

FIELD OF THE INVENTION

Embodiments of the present disclosure include dispensers, and more particularly, dispensers for dispensing and metering a liquid, such as liquefied natural gas.

BACKGROUND OF THE DISCLOSURE

Generally speaking, liquefied natural gas (LNG) presents a viable fuel alternative to, for example, gasoline and diesel fuel. More specifically, LNG may be utilized as an alternative fuel to power certain vehicles. However, a primary concern in commercializing LNG includes accurately measuring the amount of LNG that is dispensed for use. Particularly, the National Institute of Standards and Technology of the United States Department of Commerce has developed guidelines for federal Weights and Measures certification, whereby dispensed LNG must be metered on a mass flow basis with a certain degree of accuracy. Such a mass flow may be calculated by measuring a volumetric flow rate of the LNG and applying a density factor of the LNG to that volumetric flow rate.

Typically, LNG dispensers may be employed to dispense LNG for commercial use. Such LNG dispensers may use mass flow measuring devices, such as a Corilois-type flow meter, or may include devices to determine the density of the LNG and the volumetric flow of the LNG. For example, the density may be determined by measuring the dielectric constant and the temperature of the LNG flowing through the dispenser. As the LNG flows through a dispensing chamber of the dispenser, a capacitance probe may measure the dielectric constant, and a temperature probe may measure the temperature. The measured dielectric constant and temperature may then by utilized to calculate the density of LNG flowing through the dispenser by known principles. A volumetric flow rate of the LNG may then be determined by, for example, a volumetric flow meter associated with the dispensing chamber. The acquired density and volumetric flow rate may be used to compute the mass flow rate of the dispensed LNG.

The existing configuration of LNG dispensers may have certain limitations. For example, LNG dispensers utilizing a Coriolis-type flow meter must be cooled to a suitable LNG temperature prior to dispensing, which requires metered flow of LNG to be diverted back to an LNG source. In addition, Coriolis-type flow meters are generally expensive. Furthermore, typical LNG dispensers house both the density-measuring device and the volumetric flow-measuring device within the same chamber, which results in and undesirably bulky LNG dispenser. The dispenser of the present disclosure is directed to improvements in the existing technology.

SUMMARY OF THE DISCLOSURE

In accordance with an embodiment, a dispenser for dispensing a liquid may include a measurement chamber configured to receive the liquid, a temperature probe positioned within the measurement chamber, and a capacitance probe positioned within the measurement chamber. The capacitance probe may house the temperature probe. The dispenser may also include a first conduit fluidly coupled to the measurement chamber and configured to deliver the liquid out of the dispenser.

Various embodiments of the disclosure may include one or more of the following aspects: the capacitance probe may include a plurality of concentric electrode rings; the temperature probe may be positioned within an innermost electrode ring of the plurality of concentric electrode rings; the innermost electrode ring may be electrically grounded; the temperature probe and the capacitance probe may share a common central axis; a flow-measuring device fluidly coupled to the measurement chamber; the flow-measuring device may include a flow meter positioned within a chamber; a second conduit may be configured to return the fluid to a source, and directly deliver the fluid to the flow meter; the measurement chamber may be configured to be filled with a static volume of the fluid; the temperature probe and the capacitance probe may be configured to be immersed in the static volume of the fluid; the flow-measuring device may include a U-shaped configuration; the fluid may be liquefied natural gas; and one or more plates may be configured to deflect vapor of the liquefied natural gas from entering the capacitance probe.

In accordance with another embodiment, a dispenser for dispensing a liquid may include a measurement chamber configured to receive the liquid, the measurement chamber may include at least one probe for measuring a property of the liquid. The dispenser may further include a first conduit configured to deliver the liquid out of the dispenser, a flow meter coupled to the first conduit, and a second conduit configured to return the liquid to a source, wherein the calibration line may be positioned upstream of the flow meter.

Various embodiments of the disclosure may include one or more of the following aspects: the first conduit may include an inlet positioned upstream of the second conduit and configured to fluidly couple the measurement chamber to the first conduit; the inlet, the second conduit, and the flow meter may be vertically stacked relative to each other along the first conduit; the at least one probe may include a temperature probe and a capacitance probe; the second conduit may be configured to directly deliver the liquid to the flow meter; and the measurement chamber may be coupled to a plurality of conduits configured to deliver configured to deliver the liquid out of the dispenser, wherein each of the plurality of conduits may include a flow meter.

In accordance with yet another embodiment of the disclosure, a dispenser for dispensing a liquid may include a measurement chamber configured to receive the liquid, the measurement chamber may include at least one probe for measuring a property of the liquid. The dispenser may further include a first conduit including an inlet in fluid communication with the measurement chamber, a flow meter coupled to the first conduit, and a second conduit configured to return the liquid to a source, wherein the inlet, the second conduit, and the flow meter may be vertically stacked relative to each other along the first conduit.

Various embodiments of the disclosure may include the following aspect: the second conduit and the inlet may be positioned upstream of the flow meter, and the inlet may be positioned upstream of the second conduit.

In accordance with yet another embodiment of the disclosure, a method for dispensing a liquid may include delivering a liquid to a dispenser, wherein the dispenser may include a measurement chamber and an outlet conduit, receiving the liquid in the measurement chamber, measuring a temperature of the liquid with a temperature probe disposed in the measurement chamber, measuring a dielectric constant of the liquid with a capacitance probe disposed in the measurement chamber, wherein the capacitance probe may house the temperature probe, measuring a volumetric flow rate of the liquid flowing through the dispenser, determining a mass flow rate of the liquid flow through the dispenser based on the volumetric flow rate, dielectric constant, and the temperature, and dispensing the liquid out of the dispenser through the outlet conduit.

In this respect, before explaining at least one embodiment of the present disclosure in detail, it is to be understood that the present disclosure is not limited in its application to the details of construction and to the arrangements of the components set forth in the following description or illustrated in the drawings. The present disclosure is capable of embodiments in addition to those described and of being practiced and carried out in various ways. Also, it is to be understood that the phraseology and terminology employed herein, as well as the abstract, are for the purpose of description and should not be regarded as limiting.

The accompanying drawings illustrate certain exemplary embodiments of the present disclosure, and together with the description, serve to explain the principles of the present disclosure.

As such, those skilled in the art will appreciate that the conception upon which this disclosure is based may readily be used as a basis for designing other structures, methods, and systems for carrying out the several purposes of the present disclosure. It is important, therefore, to recognize that the claims should be regarded as including such equivalent constructions insofar as they do not depart from the spirit and scope of the present disclosure.

DETAILED DESCRIPTION

Reference will now be made in detail to the exemplary embodiments of the present disclosure described above and illustrated in the accompanying drawings.

Figure 1:
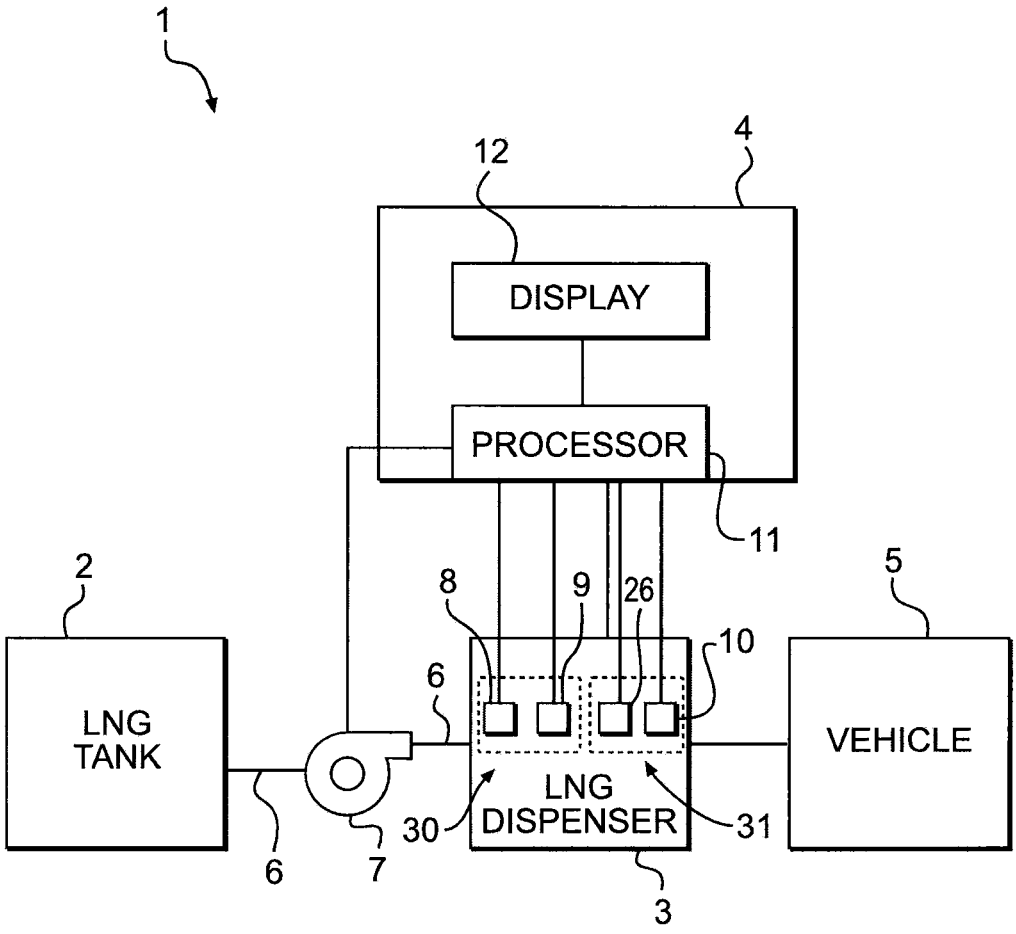
FIG. 1 illustrates a diagrammatic representation of an LNG dispensing system, according to an exemplary disclosed embodiment.

FIG. 1 illustrates a diagrammatic representation of an LNG dispensing system 1, according to an exemplary embodiment. LNG dispensing system 1 may include an LNG tank 2, an LNG dispenser 3, and a control system 4. LNG dispensing system 1 may be configured to deliver a cryogenic liquid to a use device, such as vehicles, ships, and the like. In the exemplary embodiment of FIG. 1, LNG dispensing system 1 may deliver LNG to a vehicle 5. While the present disclosure will refer to LNG as the liquid to be employed, it should be appreciated that any other liquid may be utilized by the present disclosure. Furthermore, in addition to vehicle 5, any other use device may receive the liquid from LNG dispensing system 1.

LNG tank 2 may include an insulated bulk storage tank for storing a large volume of LNG. An insulated communication line 6 may fluidly couple LNG tank 2 to LNG dispenser 3. A pump 7 may be incorporated into communication line 6 to deliver LNG from LNG tank 2 to LNG dispenser 3 via communication line 6.

Figure 5:
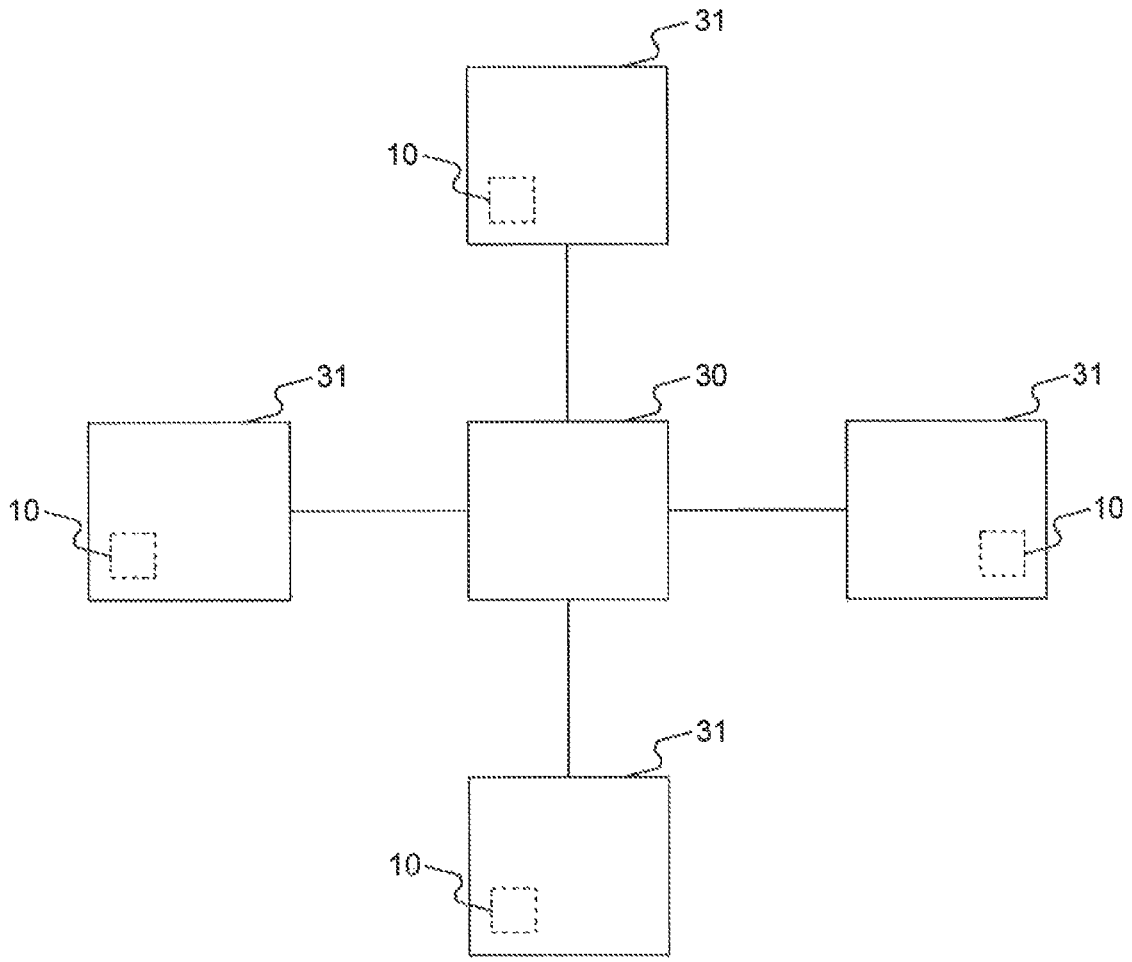
FIG. 5 illustrates a schematic depiction of an LNG dispenser, according to an exemplary disclosed embodiment.

LNG dispenser 3 may be configured to dispense LNG to, for example, vehicle 5. LNG dispenser 3 may include a density-measuring device 30 and a flow-measuring device 31. Density-measuring device 30 may be located adjacent or proximate to flow-measuring device 31. In certain embodiments, however, density-measuring device 30 may operably coupled yet separated from flow-measuring device 31 at a desired distance. Moreover, it should be appreciated that a single density-measuring device 30 may be operably coupled to a plurality of flow-measuring devices 31, as shown in FIG. 5. Density-measuring device 30 may include a capacitance probe 8 and a temperature probe 9. Capacitance probe 8 may measure a dielectric constant of the LNG flowing through LNG dispenser 3, while temperature probe 9 may measure the temperature of the flowing LNG. Flow-measuring device 31 may include a volumetric flow meter 10 and a secondary temperature probe 26. Volumetric flow meter 10 may measure a volumetric flow rate of the LNG flowing through LNG dispenser 3, and secondary temperature probe 26 may also measure the temperature of LNG.

Control system 4 may include a processor 11 and a display 12. Processor 11 may be in communication with pump 7 and LNG dispenser 3. In addition, control system 4 may also be in communication with one or more computers and/or controllers associated with a fuel station. Processor 11 may also be in communication with density-measuring device 30, including capacitance probe 8 and temperature probe 9, and flow-measuring device 31, including secondary temperature probe 26 and volumetric flow meter 10. As such, processor 11 may receive dielectric constant data, temperature data, and volumetric flow rate data to compute and determine other properties of the LNG, such as density and mass flow rate. Processor 11 may also signal pump 7 to initiate and cease delivery of LNG from LNG tank 2 to LNG dispenser 3, and may control the dispensing of LNG out from LNG dispenser 3. Moreover, processor 11 may include a timer or similar means to determine or set a duration of time for which LNG may be dispensed from LNG dispenser 3. Display 12 may include any type of device (e.g., CRT monitors, LCD screens, etc.) capable of graphically depicting information. For example, display 12 may depict information related to properties of the dispensed LNG including dielectric constant, temperature, density, volumetric flow rate, mass flow rate, the unit price of dispensed LNG, and related costs.

Figure 2:
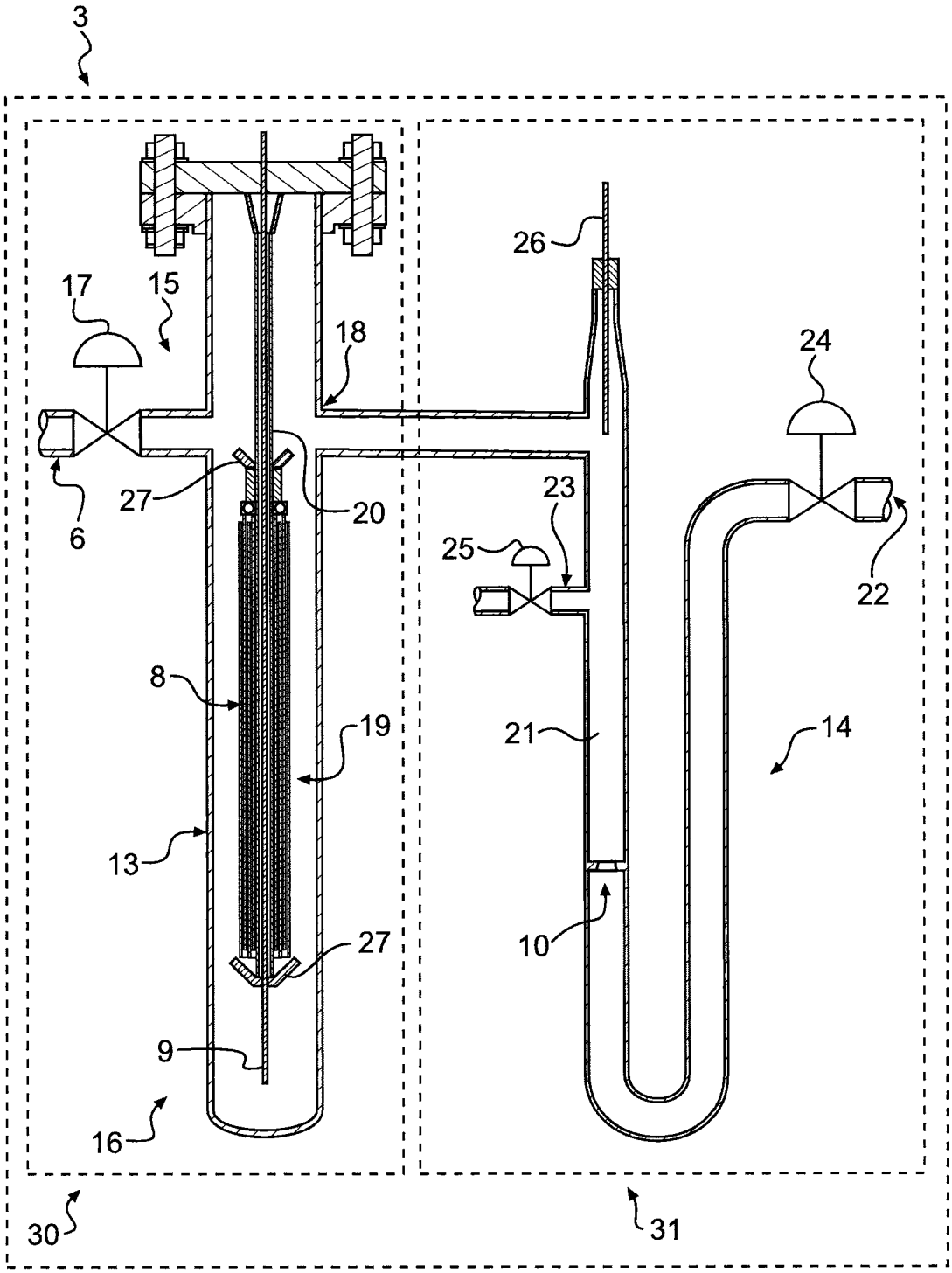
FIG. 2 illustrates a schematic depiction of an LNG dispenser, according to an exemplary disclosed embodiment.

FIG. 2 illustrates a schematic depiction of LNG dispenser 3, according to an exemplary disclosed embodiment. As shown in FIG. 2, density-measuring device 30 may include a density measurement chamber 13, an inlet conduit fluidly coupled to communication line 6, and an outlet conduit 18. Density measurement chamber 13 may include, for example, a columnar housing containing temperature probe 9, capacitance probe 8, and one or more deflector plates 27. Deflector plate 27 may be any suitable structure configured to deflect or divert LNG vapor and/or bubbles from contacting capacitance probe 8 and causing capacitance measurement inaccuracies. For example, deflector plate 27 may be a thin sheet of material coupled to capacitance probe 8 at an angle to deflect away LNG vapor and/or bubbles.

Communication line 6 may feed LNG into measurement chamber 13. FIG. 2 illustrates that communication line 6 may be positioned in an upper portion 15 of density measurement chamber 13 to provide a still-well design for density measurements. An inlet control valve 17 may be coupled to communication line 6 and may be in communication with processor 11. Accordingly, inlet control valve 17 may selectively open and close to control LNG flow into density measurement chamber 13 in response to signals from processor 11. Outlet conduit 18 may fluidly coupled density-measurement device 30 to flow-measuring device 31. Particularly, outlet conduit 18 may be positioned at or near upper portion 15 such that LNG may sufficiently fill density measurement chamber 13. In other words, the still-well design of density measurement chamber 13 may collected a static volume of LNG, with capacitance and temperature probes 8, 9 immersed in the LNG. The static volume may minimize turbulence and prolong contact between LNG and capacitance probe 8 and temperature probe 9, and deflector plates 27 may minimize or eliminate LNG vapor from entering capacitance probe, which may ultimately improve the accuracy of dielectric constant and temperature measurements.

Figure 3:
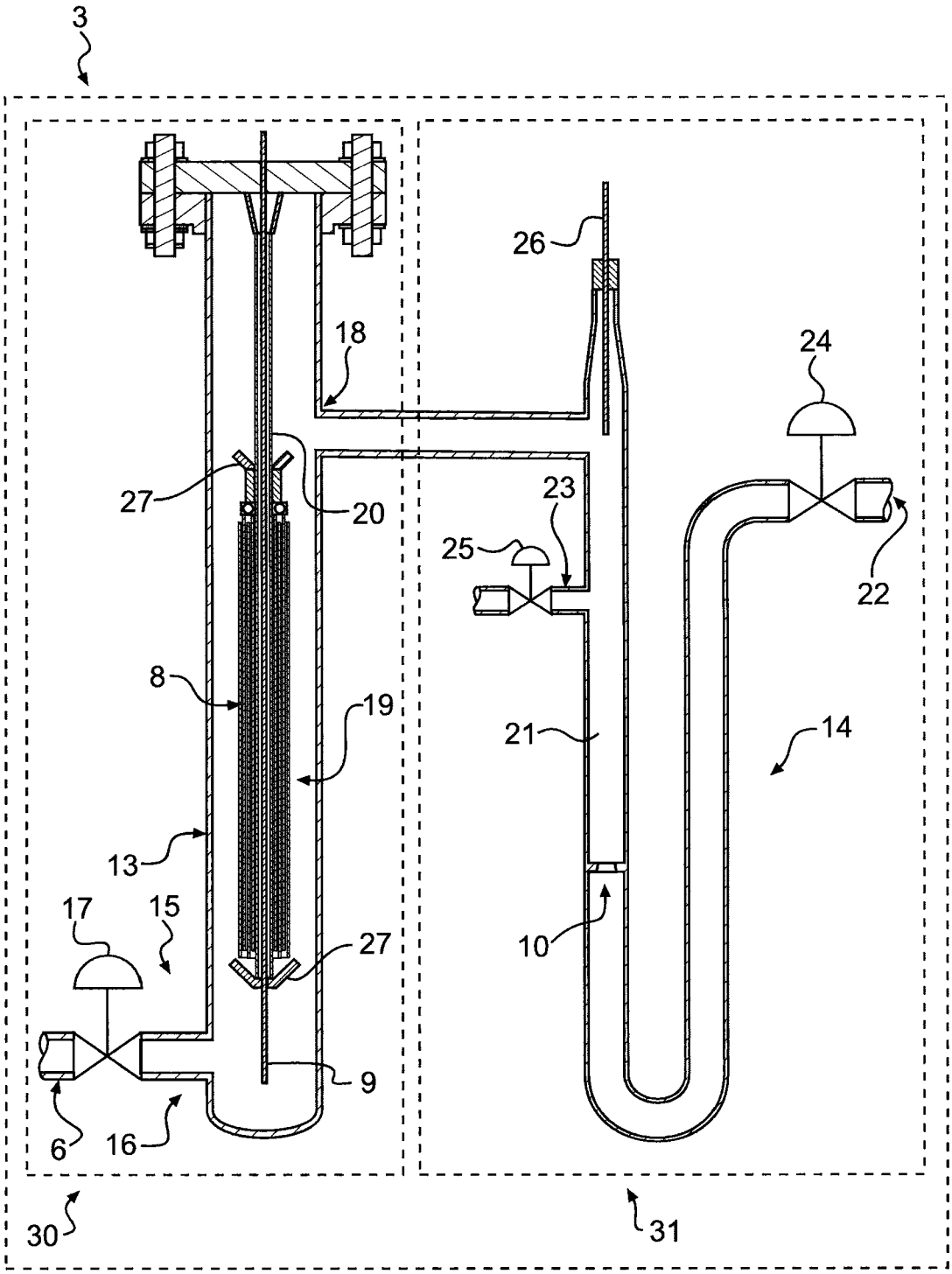
FIG. 3 illustrates a schematic depiction of another LNG dispenser, according to an exemplary disclosed embodiment.

Although FIG. 2 illustrates that communication line 6 may be positioned in upper portion 15 of density measurement chamber 13, it should also be appreciated that communication line 6 may be alternatively positioned anywhere along the length of density measurement chamber 13. For example, and as illustrated in FIG. 3, communication line 6 may be positioned in a bottom portion 16 of density measurement chamber 13. Such a configuration may provide a flow-through type design, wherein a flowing volume of LNG may contact capacitance and temperature probes 8, 9 for temperature and dielectric constant measurements.

Capacitance probe 8 may include two or more concentric electrode tubes or rings 19. As known in the art, the dielectric of the LNG between the walls of concentric electrode rings 19 may be obtained and signaled to processor 11. The measured dielectric of the LNG may then be quantified as the dielectric constant. Temperature probe 9 may be housed by capacitance probe 8. That is, temperature probe 9 may be positioned within capacitance probe 8, and particularly, may be disposed within an innermost electrode ring 20. Such a configuration may reduce the diameter of density measurement chamber 13, and therefore the overall footprint and cost of LNG dispenser 3. Furthermore, innermost electrode ring 20 may be an electrically grounded electrode. Therefore, interference or undesired influence to the dielectric or temperature readings due to incidental contact between temperature probe 9 and innermost electrode ring 20 may be prevented. Furthermore, in certain embodiments, temperature probe 9 and capacitance probe 8 may share a common central axis.

Flow-measuring device 31 may include a flow meter chamber 21, volumetric flow meter 10, an outlet chamber 14, an outlet control valve 24, an outlet conduit 22, a chill-down conduit 23, and a chill-down valve 25. Flow-measuring device 31 may receive LNG from density measurement chamber 13. In certain embodiments, flow-measuring device 31 may directly receive LNG from pump 7 if density measurements are not required.

Flow meter chamber 21 and outlet chamber 14 may be configured in a U-shape. It should be appreciated, however, that flow meter chamber 21 and outlet chamber 14 may be configured in any other shape or configuration that facilitates LNG to fill volumetric flow meter 10, fill flow meter chamber 21, and flow through chill-down conduit 23 when chill-down valve 25 is open and outlet control valve 24 is closed. Moreover, LNG may fill volumetric flow meter 10 prior to opening outlet control valve 24 to improve the accuracy of the LNG flow measurements.

Chill-down conduit 23 may be positioned upstream of volumetric flow meter 10 and outlet control valve 24 such that LNG flow through chill-down conduit 23 may not impact the measurement of LNG flow though outlet conduit 22. Chill-down conduit 23 may fluidly couple flow meter chamber 21 with LNG tank 2 and may be configured to return LNG from outlet conduit 14 to LNG tank 2. Chill-down valve 25 may be in communication with processor 11 and may be configured to selectively open and close in response to signals from processor 11. In certain embodiments, a two-way pump (not shown) may be coupled to chill-down conduit 23 to deliver and extract LNG to and from flow meter chamber 21.

Chill-down conduit 23 may return LNG back to LNG tank 2 after flow-measuring device 31 has been initially cooled. In such an initial cooling mode, LNG may be pumped from communication line 6 and into density measurement chamber 13 and flow meter chamber 21 prior to LNG measurements being taken by capacitance and temperature probes 8, 9, and prior to LNG being dispensed from outlet conduit 22. That is, flow-measuring device 31 may be filled with LNG prior to opening outlet control valve 24. The initial cooling mode therefore may calibrate the LNG dispenser 3 such that density-measuring device 30 and flow meter chamber 21 may be cooled down to a temperature substantially consistent of that of LNG within LNG tank 2. This calibration period may improve the accuracy of the dielectric constant and temperature measurements taken by capacitance and temperature probes 8, 9. In addition, calibration period may cool the structure of LNG dispenser 3. That is, calibration period may pump LNG through LNG dispenser 3 to cool the walls defining LNG dispenser 3 to further improve the accuracy of dielectric constant and temperature readings.

Because chill-down conduit 23 may be positioned upstream of volumetric flow meter 10, chill-down conduit 23 may directly feed LNG through the volumetric flow meter 10 to calibrate meter 10. For example, in some instances, LNG vapor may be present in flow meter chamber 21 and may flow through volumetric flow meter 10. Since the presence of LNG vapor in meter 10 may result in erroneous or inaccurate LNG volumetric flow rate measurements, it may be beneficial to flush out the LNG vapor prior to measuring the volumetric flow rate of LNG to be dispensed from LNG dispenser 3. Chill-down conduit 23 may directly feed LNG from LNG tank 2 to flush out any undesirable LNG vapors, thereby improving the accuracy of volumetric flow meter 10 and further cooling the outlet conduit 14. The flushing of LNG vapors from meter 10 may also be carried out during the initial cooling mode.

Volumetric flow meter 10 may include any device known in the art configured to measure the volumetric flow rate of a fluid. For example, volumetric flow meter 10 may include an orifice plate, a flow nozzle, or a Venturi nozzle. Data related to the volumetric flow rate of LNG passing through volumetric flow meter 10 may be communicated to processor 11.

Outlet control valve 24 may be coupled to outlet chamber 14 and may be in communication with processor 11. Accordingly, outlet control valve 24 may selectively open and close to control LNG dispensed from outlet chamber 14 in response to signals from processor 11.

In one or more embodiments, secondary temperature probe 26 may be positioned within flow meter chamber 21. Secondary temperature probe 26 may be in communication with processor 11 and configured to measure the temperature of LNG flowing through flow meter chamber 21. LNG temperature between density-measuring device 30 and flow meter chamber 21 may therefore be tracked by processor 11, and any substantial deviations in LNG temperature may be identified.

Outlet chamber 14 may exhibit a vertical configuration. In other words, secondary temperature probe 26, inlet 18, LNG calibration line 23, and volumetric flow meter 10 may be vertically stacked relative to each other along flow meter chamber 21. Such a configuration may reduce the size and overall footprint of flow-measuring device 31.

Although only one flow-measuring device 31 fluidly coupled to density-measuring device 30 is illustrated, it should be appreciated that LNG dispenser 3 may include more than one flow-measuring device 31. Multiple flow-measuring devices 31 may advantageously measure and deliver LNG to multiple destinations (e.g., multiple use vehicles), while utilizing a single density-measuring device 30 to measure and track LNG density via LNG temperature and dielectric constant. The single density-measuring device 30 may reduce the overall space and equipment necessary for LNG dispenser 3.

Figure 4:
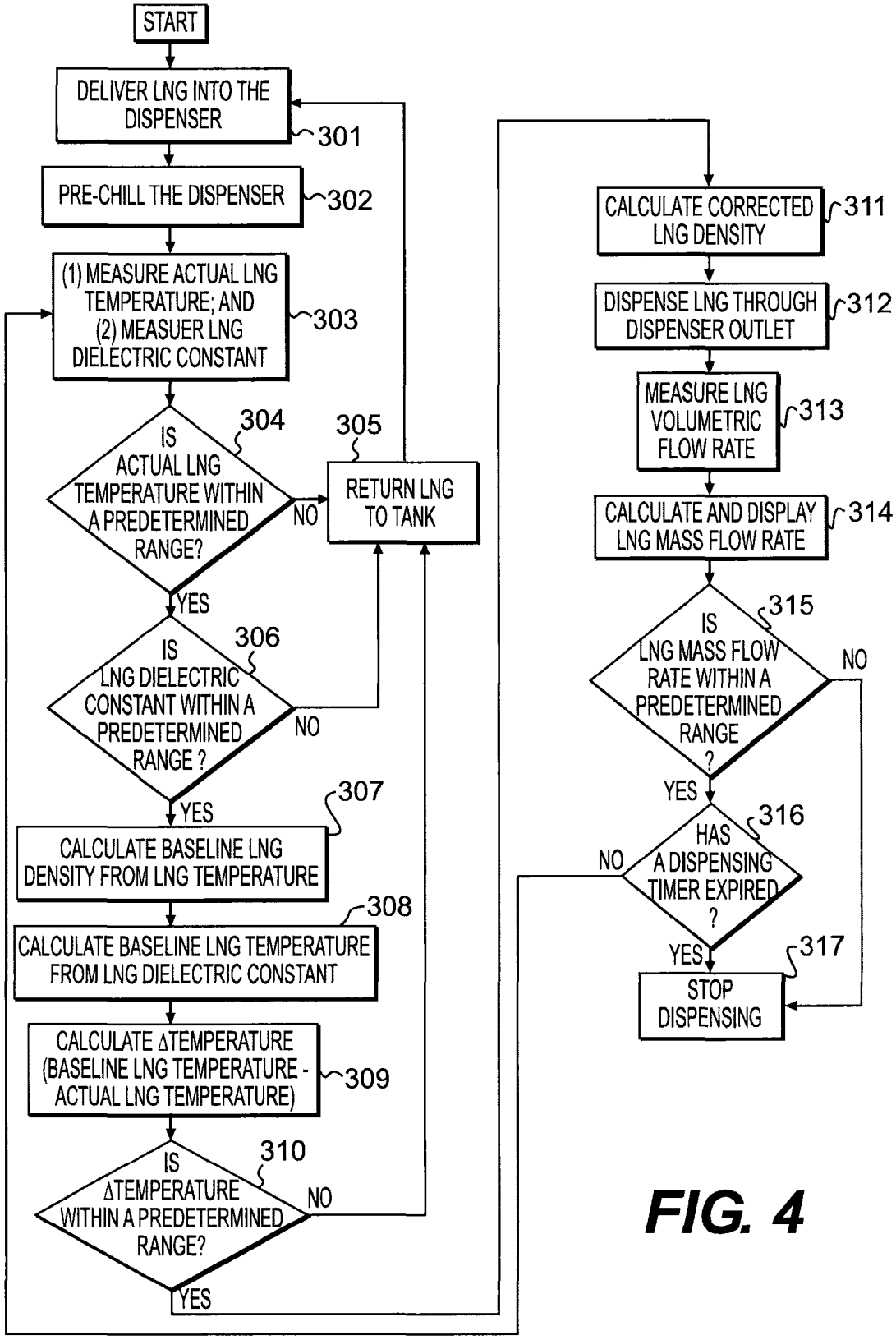
FIG. 4 illustrates a block diagram for an exemplary process of dispensing LNG by the LNG dispensing system of FIG. 1, according to an exemplary disclosed embodiment.

FIG. 4 is a block diagram illustrating a process of dispensing LNG by LNG dispensing system 1, according to an exemplary disclosed embodiment. LNG may first be delivered into LNG dispenser 3 from LNG tank 2, step 301. However, prior to dispensing LNG out of LNG dispenser 3, LNG dispenser 3 may be "pre-chilled," step 302. In other words, LNG dispenser 3 may undergo the above-described initial cooling mode, where LNG is pumped from LNG tank 2, through LNG dispenser, and back to LNG tank 2 via chill-down conduit 23. Outlet control valve 24 may be in a closed positioned at this stage. LNG dispenser 3 therefore may be sufficiently cooled to approximately the temperature of the LNG from LNG tank 2. Furthermore, the "pre-chill" stage may include the step of flushing out any LNG vapor that may be present within flow meter chamber 21. That is, LNG from tank 2 may be directly pumped through flow-measuring device 31 via LNG calibration line 23 to expel any LNG vapors that may create inaccurate readings by meter 10 by filling meter 10 with LNG. Additionally, or alternatively, LNG delivered from density-measuring device 30 may be pumped through flow-metering device to flush out any LNG vapors.

It should be appreciated that prior to the "pre-chill" stage, capacitance probe 8 and temperature probe 9 may be calibrated for measuring LNG by any process known in the art.

During the "pre-chill" stage, temperature probe 9 (and in some embodiments secondary temperature probe 26) may track the temperature of LNG flowing through LNG dispenser 3. The temperature readings may be sent to processor 11 and displayed on display 12. Once the temperature has stabilized, LNG dispenser 3 may have reached a sufficient cooling temperature, and chill-down control valve 25 may be closed. Properties of the to-be-dispensed LNG may then be measured from a static volume of LNG or a flowing volume of LNG within density-measuring device 30, step 303.

Temperature probe 9 may measure the actual LNG temperature within density-measuring device 30, and capacitance probe 8 may measure the LNG dielectric constant of the LNG within density-measuring device 30. Actual LNG temperature and LNG dielectric constant may be transmitted to processor 11 for evaluation and computational purposes. For example, processor 11 may compare the actual LNG temperature to a predetermined range of temperatures stored in a memory unit of processor 11, step 304. Processor 11 may determine that the actual LNG temperature is at an appropriate dispensing temperature if the actual LNG temperature is within a predetermined range of acceptable LNG dispensing temperatures (e.g., between −260° F. and −170° F.). In one embodiment, the predetermined range of acceptable LNG dispensing temperatures may be based on set standards for Weights and Measures certification. If processor 11 determines that the actual LNG temperature is not within a predetermined range of acceptable LNG dispensing temperatures, processor 11 may actuate chill-down control valve 25 (and in certain embodiments the pump associated with chill-down conduit 23) to deliver LNG within LNG dispenser 3 back to LNG tank 2, step 305. LNG from tank 2 may then be delivered to LNG dispenser 3, step 301.

If actual LNG temperature is within the predetermined range of acceptable LNG temperatures, processor 11 may then compare the measured LNG dielectric constant to a predetermined range of dielectric constants stored in the memory unit of processor 11, step 306. For instance, processor 11 may determine that the LNG dielectric constant is indicative of LNG appropriate for dispensing if the LNG dielectric constant is within a predetermined range of acceptable LNG dielectric constants (e.g., between 1.48 and 1.69). In one embodiment, the predetermined range of acceptable LNG dielectric constants may be based on set standards for Weights and Measures certification. If processor 11 determines that the LNG dielectric constant is not within a predetermined range of acceptable LNG dielectric constants, LNG within LNG dispenser 3 may be returned back to LNG tank 2, step 305, or dispensing may be disabled.

However, if the LNG dielectric constant is within the predetermined range, processor 11 may calculate a baseline LNG density based on the measured LNG temperature from secondary temperature probe 26, step 307. Processor 11 may utilize programmed look-up tables, appropriate databases, and/or known principles and algorithms to determine the baseline LNG density based on the measured LNG temperature from secondary temperature probe 26.

Because the composition of LNG may vary as it is pumped through LNG dispenser 3, LNG density calculations may need to be determined throughout the dispensing operation. The calculated LNG density will be determined by incorporating algorithms based on the relationship between LNG dielectric constant and LNG temperature, as described below.

Processor 11 may determine a baseline LNG temperature based on the measured LNG dielectric constant, step 308. The baseline LNG temperature may be a temperature correlating to the measured LNG dielectric constant. That is, the baseline LNG temperature may be what the temperature of the LNG should be assuming the LNG has the measured dielectric constant and a baseline composition (e.g., 97% methane, 2% ethane, and 1% nitrogen or any other baseline composition). To determine the baseline LNG temperature, processor 11 may utilize pre-programmed data and/or known principles and algorithms.

Processor 11 then may calculate the difference between the baseline LNG temperature and the actual LNG temperature, step 309, and determine whether the temperature difference is within a predetermined range (e.g., between −25° F. and 25° F.), step 310. In one embodiment, the predetermined range of temperature differentials may be based on set standards for Weights and Measures certification. If the temperature difference is not within the predetermined temperature range, the LNG within the LNG dispenser 3 may be returned to LNG tank 2, step 305, or dispensing may be disabled.

If the temperature difference is within the predetermined range, processor 11 may then calculate a corrected LNG density, step 311. The corrected LNG density may compensate for variations in LNG composition. Particularly, processor 11 may calculate a density correction factor based on the difference between the actual and baseline LNG temperatures. Density correction factor may be calculated by inputting the temperature difference into known principles, algorithms, and/or equations programmed into processor 11.

The density correction factor may then be applied to the baseline LNG density to determine the corrected LNG density. Particularly, processor 11 may multiply the baseline LNG density with the density correction factor to calculate the corrected LNG density.

Once the corrected LNG density is obtained, processor 11 may actuate outlet control valve 24 to dispense the LNG out of outlet conduit 22, step 312. As the LNG is dispensed from LNG dispenser 3, processor 11 may obtain a volumetric flow rate of LNG measured by volumetric flow meter 10, step 313. As is known in the art, processor 11 may apply the corrected LNG density to the volumetric flow rate to arrive at a mass flow rate of the dispensed LNG, step 314. Moreover, processor 11 may continually update and display the mass flow rate of the dispensed LNG.

Processor 11 may further determine whether the mass flow rate of the dispensed LNG is within a predetermined range of acceptable mass flow rates, step 315. The predetermined range of acceptable mass flow rates may be bound by a minimum acceptable mass flow rate and a maximum acceptable mass flow rate. If the measured mass flow rate of the dispensed LNG is between the minimum and maximum acceptable mass flow rates, LNG dispensing system 1 may continue to dispense LNG through LNG dispenser 3, and may continue to measure and update the mass flow rate of the dispensed LNG. However, if the mass flow rate of the dispensed LNG is outside the predetermined range (e.g., less than the acceptable minimum mass flow rate or greater than the acceptable maximum mass flow rate), processor 11 may then determine whether the LNG has been dispensed for an appropriate duration of time, which may be preset by processor 11. For example, processor 11 may determine if a dispensing timer set by processor 11 has expired, step 316. If the dispensing timer has expired, LNG dispensing system 1 may terminate LNG dispensing, step 317.

With an accurate measurement of LNG mass flow rate, LNG dispensing system 1 may dispense a desired or a predetermined mass of LNG to, for example, vehicle 5. Particularly, processor 11 may determine the mass of LNG dispensed by monitoring an amount of time LNG is dispensed at the measured LNG mass flow rate. Once processor 11 has determined that the mass of the dispensed LNG has reached the desired mass, processor 11 may terminate LNG dispensing.

The many features and advantages of the present disclosure are apparent from the detailed specification, and thus, it is intended by the appended claims to cover all such features and advantages of the present disclosure which fall within the true spirit and scope of the present disclosure. Further, since numerous modifications and variations will readily occur to those skilled in the art, it is not desired to limit the present disclosure to the exact construction and operation illustrated and described, and accordingly, all suitable modifications and equivalents may be resorted to, falling within the scope of the present disclosure.

What is claimed is:

1. A dispenser for dispensing a fluid, comprising:

a measurement chamber configured to receive the fluid;

a temperature probe positioned within the measurement chamber;

a capacitance probe positioned within the measurement chamber, wherein the capacitance probe houses the temperature probe;

a first conduit having an inlet fluidly coupled to the measurement chamber and configured to deliver the fluid out of the dispenser;

a flow-measuring device located external to the measurement chamber and coupled to the first conduit; and a second conduit having a first end configured to communicate with a source and a second end that directly and structurally connects the second conduit to the first conduit at a location external to the measurement chamber, so that the second conduit is configured to form a pathway that connects the source and the first conduit;

wherein the pathway directly and structurally connects the source to the first conduit, the pathway being completely external to the measurement chamber;

wherein the inlet, the second conduit, and the flow-measuring device are vertically stacked relative to each other along the first conduit so that the inlet is located above the second conduit, and the second conduit is located above the flow-measuring device.

2. The dispenser of claim 1, wherein the capacitance probe includes a plurality of concentric electrode rings.

3. The dispenser of claim 2, wherein the temperature probe is positioned within an innermost electrode ring of the plurality of concentric electrode rings.

4. The dispenser of claim 3, wherein the innermost electrode ring is electrically grounded.

5. The dispenser of claim 3, wherein the temperature probe and the capacitance probe share a common central axis.

6. The dispenser of claim 1, wherein the flow-measuring device includes a flow meter.

7. The dispenser of claim 1, wherein the measurement chamber is configured to be filled with a static volume of the fluid.

8. The dispenser of claim 7, wherein the temperature probe and the capacitance probe are configured to be immersed in the static volume of the fluid.

9. The dispenser of claim 1, wherein the flow-measuring device includes a U-shaped configuration.

10. The dispenser of claim 1, wherein the fluid is liquefied natural gas.

11. The dispenser of claim 10, further comprising one or more plates configured to deflect vapor of the liquefied natural gas and bubbles from entering the capacitance probe.

12. A dispenser for dispensing a liquid, comprising:

a measurement chamber configured to receive the liquid, the measurement chamber including a temperature probe housed within a capacitance probe for measuring the liquid;

a first conduit configured to deliver the liquid out of the dispenser, the first conduit having an inlet in fluid communication with the measurement chamber;

a flow meter located external to the measurement chamber and coupled to the first conduit; and a second conduit configured to return the liquid to a source via a pathway, wherein the second conduit directly and structurally connects to the first conduit upstream of the flow meter at a location external to the measurement chamber and between the measurement chamber and the flow meter, wherein the inlet, the second conduit, and the flow meter are vertically stacked relative to each other along the first conduit so that the inlet is located above the second conduit, and the second conduit is located above the flow meter;

wherein the pathway directly and structurally connects the source to the first conduit; the pathway being completely external to the measurement chamber.

13. The dispenser of claim 12, wherein the second conduit is configured to directly deliver the liquid to the flow meter.

14. The dispenser of claim 12, wherein the measurement chamber is coupled to a plurality of conduits configured to deliver the liquid out of the dispenser, wherein each of the plurality of conduits includes a flow meter.

15. A dispenser for dispensing a liquid, comprising:

a measurement chamber configured to receive the liquid, the measurement chamber including a temperature probe housed within a capacitance probe for measuring the liquid;

a first conduit including an inlet in fluid communication with the measurement chamber;

a flow meter coupled to the first conduit at a location external to the measurement chamber; and a second conduit having a first end configured to communicate with a source and a second end that directly and structurally connects the second conduit to the first conduit at a location external to the measurement chamber, so that the second conduit is configured to form a pathway that connects the source and the first conduit;

the pathway directly and structurally connects the source to the first conduit; the pathway being completely external to the measurement chamber;

wherein the inlet, the second conduit, and the flow meter are vertically stacked relative to each other along the first conduit so that the inlet is located above the second conduit, and the second conduit is located above the flow meter.

16. A method for dispensing a liquid, comprising:

delivering a liquid to a dispenser, wherein the dispenser includes a measurement chamber and an outlet conduit having an inlet coupled to the measurement chamber;

receiving the liquid in a pre-chill conduit directly and structurally coupled to the outlet conduit at a location external to the measurement chamber, and passing the liquid through a flow-measuring device coupled to the outlet conduit at a location external to the measurement chamber, the pre-chill conduit directly and structurally connecting the source to the outlet conduit; the pre-chill conduit being located completely external to the measurement chamber;

receiving the liquid in the measurement chamber;

measuring a temperature of the liquid with a temperature probe disposed in the measurement chamber;

measuring a dielectric constant of the liquid with a capacitance probe disposed in the measurement chamber, wherein the capacitance probe houses the temperature probe;

measuring a volumetric flow rate of the liquid flowing through the dispenser with the flow-measuring device;

the inlet, the pre-chill conduit, and the flow meter being vertically stacked relative to each other along the outlet conduit so that the inlet is located above the pre-chill conduit, and the pre-chill conduit is located above the flow meter;

and dispensing the liquid out of the dispenser through the outlet conduit.

17. The method of claim 16, wherein the liquid is received from the source via the pre-chill conduit.

18. The method of claim 17, wherein receiving the liquid via the pre-chill conduit pre-chills the dispenser.

19. The method of claim 16, wherein the liquid is directed from the pre-chill conduit, through the flow-measuring device, and then returned to the source via the pre-chill conduit.

20. The method of claim 16, further comprising determining a mass flow rate of the liquid flow through the dispenser based on the volumetric flow rate, dielectric constant, and the temperature.

* * * * *